US007111844B2

(12) United States Patent
Andrie et al.

(10) Patent No.: US 7,111,844 B2
(45) Date of Patent: Sep. 26, 2006

(54) STACKABLE MAGNETIC-PLATE GAME PIECE DESIGN

(76) Inventors: Craig Andrie, 3889 S. Elkhart St., Aurora, CO (US) 80014; Jeffrey Almeida, 3889 S. Elkhart St., Aurora, CO (US) 80014

( * ) Notice: Subject to any disclaimer, the term of this patent is extended or adjusted under 35 U.S.C. 154(b) by 0 days.

(21) Appl. No.: 10/785,923

(22) Filed: Feb. 23, 2004

(65) Prior Publication Data

US 2004/0188936 A1 Sep. 30, 2004

Related U.S. Application Data

(60) Provisional application No. 60/449,802, filed on Feb. 24, 2003.

(51) Int. Cl.
*A63F 3/00* (2006.01)

(52) U.S. Cl. ..... 273/290; 273/255; 273/262

(58) Field of Classification Search ..... 273/288, 273/289, 290, 291, 260, 261, 255, 262, 265
See application file for complete search history.

(56) References Cited

U.S. PATENT DOCUMENTS 1,605,703 A * 11/1926 Brown ..... 273/239
3,856,309 A * 12/1974 Helfgott ..... 273/288
3,963,242 A * 6/1976 Treugut et al. ..... 273/261
4,004,809 A * 1/1977 Schreiber ..... 273/248
4,078,804 A * 3/1978 Coster et al. ..... 273/284
5,246,373 A * 9/1993 Becker ..... 434/129
5,332,229 A * 7/1994 Fielder et al. ..... 273/271
6,478,300 B1 * 11/2002 Pickett ..... 273/260
6,659,463 B1 * 12/2003 Mackey ..... 273/276
6,899,333 B1 * 5/2005 Weisman ..... 273/289
2004/0012148 A1 * 1/2004 Wittig ..... 273/236

* cited by examiner

*Primary Examiner*—Vishu Mendiratta
(74) *Attorney, Agent, or Firm*—Leyendecker & Lemire LLC; Kurt Leyendecker

(57) ABSTRACT

A method for designating the attributes of a character in a game: providing a plurality of replaceable stackable pieces in which each stackable pieces in which each piece represents a attribute of the character/creature in play. A dynamic game piece representing a character/creature for use in a role play or simulation game comprising: a plurality of interchangeable stackable game pieces wherein; basic colored plates can be used to represent statistical information such as health status, magical effects, equipment in play, timing, spatial effects, etc. in conjunction with miniatures. Also, wherein; specialized pates can be painted to represent creatures/characters to be used as an alternative to miniatures or other tokens and are marked to indicate direction. Also, wherein, packaging of the game pieces can be accomplished in a way as to create a collectable aspect to the pieces.

1 Claim, 1 Drawing Sheet

STACKABLE MAGNETIC-PLATE GAME PIECE DESIGN

CLAIM OF PRIORITY

The present invention claims priority of U.S. Ser. No. 60/449,802 filed Feb. 24, 2003.

FIELD OF THE INVENTION

The present invention is directed to a novel game piece design for use in conjunction with miniature-based gaming systems.

BACKGROUND OF THE INVENTION

Role playing and simulation games such as "Dungeons and Dragons" have gained great popularity in recent years. In the current market of role-playing and war-gaming simulation, there are only a few options for representing information during game play. These include the use of miniatures, printed paper or cardboard tokens, or home-grown strategies employing any number of informal conventions developed by players including coins, blocks, or other materials to represent information during play.

All of these methods provide spatial information, but are extremely limited in providing other key information regarding the game. One recent addition to the industry has been miniatures attached to a base that has a rotating dial depicting a limited set of variable information. While this mechanism provides some advantages over traditional miniatures it is limited in functionality, not visually effective, and is somewhat difficult to operate. U.S. patent application No. 2002/0180150 discloses such a system for keeping rules and record keeping in a virtual character type game, using counters and wheels in the context of a particular game. The invention shown therein discloses a system of dials and counters but does not easily and readily identify the condition or attributes of the player in a clear and dynamic way.

Other patents have issued related to game pieces and the like. U.S. Pat. No. 6,361,047 discloses a game system having a playing board which comprises one or more regions of polarized adhesion material, and a plurality of playing pieces, each with two faces, which may have polarized adhesion material of one or both types. The polarized adhesion material is preferably hook and loop fastener material. The games rules provide that playing pieces are deposited only where adhesion is strong, and may be stacked in accordance with this rule. Other rules are applied to define and differentiate game play. The game board is optionally reconfigurable, and may also have integrated electronics. The game board may include a foldable housing to contain the playing pieces when not in use.

U.S. Pat. No. 5,848,788 discloses a magnetic game comprising a game board having a playing surface with an array of first and second playing areas. The first playing area includes at least one electro-magnet. A plurality of game pieces are adapted to be placed on the first or second playing areas and to flip in the air if the electro-magnet and the game piece magnet are of opposite polarity. Each game piece has a game piece magnet. The magnetic game further includes a light-emitting element positioned proximal the first playing area. The light-emitting element is configured to be in electrical communication with a power supply. A light-sensitive transducer is positioned proximal to the second playing area. The light-sensitive transducer is configured to be placed in electrical communication with the power supply. The light-emitting element is illuminated when a shadow is cast over the light sensitive transducer.

U.S. Pat. No. 6,293,550 discloses a magnetic version of the game "Tic-Tac-Toe". In the preferred mode, the game consists of twelve separate pieces die cut from a magnetic rubber sheet. Each set contains four elongated strips, intended to be arranged to create the tic-tac-toe board. In addition, the assembly includes four crosses (X's) and four circles ("O's"), each several inches in length and/or diameter. Importantly, the top surface of each game piece may be laminated with previously determined colors, patterns, text, or other graphics to enhance the appearance thereof. Thus, the present invention provides a complete game that may be adhered to any metallic surface, and used for entertainment, amusement, or decorative purposes.

U.S. Pat. No. Des. 393,667 discloses an ornamental design for a magnetic game piece, as shown and described in the figures. It is a primary object of the present invention to provide highly effective visual impact and richer depiction of information. It is a further object to provide highly customizable to game and style of play, ease of use, and possible standardization of usage conventions.

While there are a number of patents, none adequately address to easily and graphically provide key information regarding the game.

A principle object of the invention to provide a flexible, easy to use, highly visual tool for depicting dynamic information during game play using miniatures. The primary applications of the invention are war games, battle simulation games and fantasy role-playing games wherein players typically use miniatures to represent characters, creatures, equipment and other aspects of the game. The present invention seeks to improve over miniatures are limited in their ability to visually communicate richer, dynamic information that would streamline play.

A critical object of this invention is to be used to provide a more a cost-effective, durable alternative to the use of conventional miniatures.

A principal object of the invention is to be used largely as an alternative to conventional miniatures, providing more durability than printed cardboard tokens.

It is an additional advantage of the invention is that is can be easily packaged to introduce the concepts of related sets, rarity, and chance, thereby creating a collectable aspect to the sale of these game pieces. This would be similar in nature to collectable cards where a sealed pack with unknown content is purchased in hopes of obtaining rare and more valuable cards.

These and other objects of the present invention will become apparent from the detailed description which follows.

SUMMARY OF THE INVENTION

In accordance with the present invention, a method for designating the unique identity and attributes of a character or creature in a simulation game comprising the following steps: providing a plurality of replaceable stackable pieces in which each piece represents an attribute of the character or creature.

In further embodiments, the stackable pieces are placed below a standard miniature of a character or creature; and the attribute represents an aspect of the health status, magical effects, equipment in play, timing, or spatial information, regarding the character or creature.

The invention also comprises a dynamic game piece representing a character or creature for use in a role play or simulation game comprising: a plurality of interchangeable stackable game pieces wherein; at least one of the game pieces is marked with a picture of the character and is marked so as to represent the direction of the character or creature; and the picture of the character or creature appears on the top of the pieces. The pieces may be held together magnetically; or held together by a snap closure. Additional pieces can be added or subtracted to represent the increase or decrease in attributes.

In a further embodiment, the invention is a method of designating a set of related game pieces wherein a first color scheme of the piece represents the set of the pieces, and alternate colors represent an attribute of the pieces. The game pieces can form a collectable set.

DETAILED DESCRIPTION OF THE INVENTION

The present invention is described with reference to the enclosed FIGS. wherein the same numbers are used where applicable. In a preferred embodiment, the components of the invention broadly comprise magnetically interlocking colored plates. The most basic use of this invention occurs when players place one or more "plates" under a conventional miniature thereby conveying information based on color and or edge-markings of the plate. Stacking and unstacking plates visually conveys changing information throughout the game.

Figure 1:
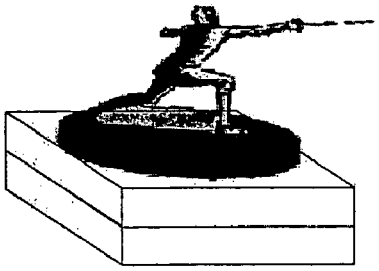
FIG. 1 is a perspective view of base-plates being used in conjunction with a miniature.

For purposes of explanation, the following two examples are shown as depicted in FIG. 1. A shown, the invention is described in the context of plurality of plates 10. The plates shown are "base plates" as they are typically a solid color with no particular markings. The plates are designed to be placed under a miniature or a "top plate" that takes the place of a miniature. The top-plates are shown and described in the in the remaining FIGS.

Characters in dungeons-and-dragons-type variants measure health using hit-points. When damage is done to a character, the hit-points are reduced until they reach a predefined number indicating death. During the game, a player might place a yellow plate under their character to indicate that they have been "moderately" wounded. An orange plate could be used when the character's condition reached "seriously wounded", and a red plate could be used to indicate a "near death" status. Other players could easily see this and adjust their play accordingly.

The stacking nature of the plates enables a wide range of information to be simultaneously communicated. Extending the previous example, light blue plates could be used to indicate height for flying with each blue plate indicating a 20 foot increment. By placing one blue plate and one orange plate under a miniature the players could easily "see" that the character is flying at 0–20 feet and is seriously wounded.

Specific game rules and styles of play vary tremendously. The invention provides a multiplicity of possible combinations of color and edge markings. While producers of the product may develop "standard" usages for the colors and edge markings, the flexibility will still be there for players to devise whatever combinations they find most useful to streamline their play.

Figure 2:
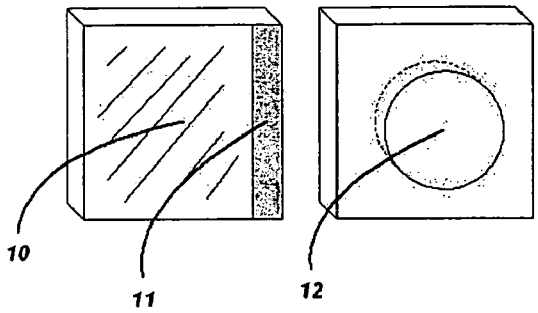
FIG. 2 is a perspective view of a typical top-plate standing on end, showing what would be the top and bottom of the game piece.

FIG. 2 illustrates a generic top-plate standing on edge. The size of the plate will correspond to a scale indicated in a particular game. In a typical "Dungeons-and-Dragons" game environment a grid of one inch squares are used, each representing a five foot square area. For that particular play environment, plates would be manufactured in one inch squares representing the typical space occupied by a character. Other sizes can obviously be accommodated to handle creatures or items that cover larger areas or to handle alternate scales used in other gaming environments.

As FIG. 2 illustrates several key design features incorporated into the top-plates. The cross hatch section 14 shows a typical area for artwork or embossing. The shaded bar 16 depicts how to convey the direction the miniature is facing. The circle indicated by 12 shows an embedded magnet which would not be visible from the top of the plate, and may or may not be hidden by covering material on the underside of the plate.

Figure 3:
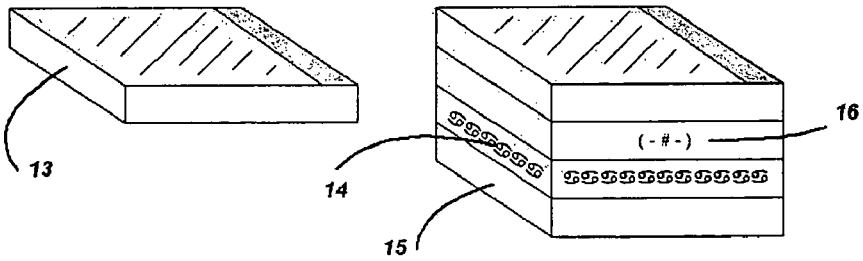
FIG. 3 is a perspective view of how a top-plate would be seen laying on a playing surface and how it could be stacked on other types of plates.

FIG. 3 illustrates how a top-plate would be used by resting flat 13 on the playing surface. The stacking technique is also shown with several design features pointed out. Edge designs 14 can be used to indicate virtually anything, ranging from words to meaningful icons to geometric patterns. The combination of color and pattern can provide an endless set of potential meanings. Base plates of solid color 15 are the simplest design and can be used to develop a core set of standard meanings for any game. Numbered plates 16 can provide unique identification between multiple creatures or could be used in combination with various colors to provide quick numeric information on a key attribute.

The use of embedded magnets helps facilitate the stacking and movement of pieces, enabling the players to easily move an entire stack without inadvertently knocking them over and causing delays in the game.

Using top-plates to depict creatures or non-essential characters provides a high level of convenience for those people who organize the games for others. However, most individual players will still want to have the equivalent of a "miniature" that reflects their personal style and view of the character.

Figure 4:
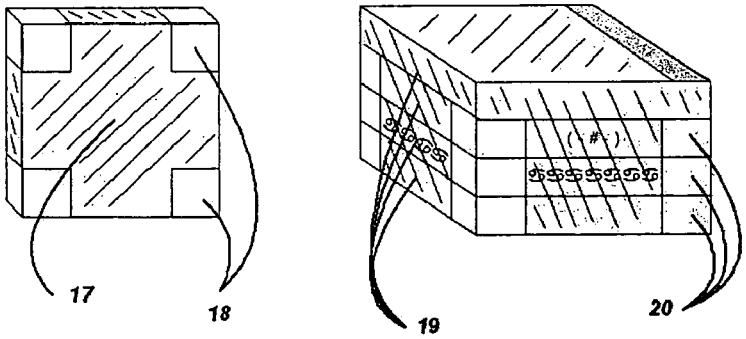
FIG. 4 is a perspective view showing how a related "set" of plates could be created which could take the place of a traditional miniature.

FIG. 4 depicts how the invention can meet this requirement by incorporating a common color into all plates. A "set" can then be developed representing all aspects of a miniature. The corners 18 are left free to be assigned colors as described for base-plates above. Extending the example, a piece with orange corners would still indicate "seriously wounded", while the common color provides visual cohesion for the stack of plates. The result is shown as the cross hatched sections 19 which share a unique color. The corners 18 could also be of that same color or could be other colors conveying information as described in previous examples. It will be obvious to those skilled in the art that the corners and core color sections could be inverted to accomplish the same idea. This may be more effective visually.

The following example illustrates the operation and use of the invention. A game-master sets up a typical miniature based campaign setting, including a map laid out on a table with walls, doors and other features drawn in for the players.

The players, using traditional miniatures, move them through the rooms until they encounter a group of six skeletons. At this point the game-master places six top-plates with pictures of skeletons into the room in appropriate places. The players can tell what the creatures are, but cannot tell one from the other.

To remedy this issue the game-master places a numbered plate under each of them giving them a number from 1 to 6 enabling everyone to distinguish the individual creatures. Identification of an individual within a group is a highly useful aspect of this invention. This numbering could be accomplished by pre-numbered/painted pieces or by using a dry/wet erase maker on a standard base piece.

Battle ensues and the creatures are attacked by the players. The players can now easily identify each creature and tell the other players and the game-master which one they are attacking. When damage is dealt, the game-master assesses the relative severity and places an orange colored plate under a skeleton indicating "severely wounded". Players seeing this can adjust their play based on the information as their characters might in a real melee setting. This enhances the opportunity for role play and enriches the game.

Likewise, the skeletons on their turn damage a player, again inflicting a severe wound. Additionally the skeleton paralyzes its victim. At this point the game master can place an orange plate under the player's miniature along with a special black plate with a skull sign on the edge. The players know this means the player is paralyzed as well as seriously wounded and can again adjust their play. This is an example of using a plate to indicate a magical effect during play.

As the battle rages, a player places a new stack of plates into the melee, introducing a new character that is being brought into the game. The character's picture is on the top-plate and there are three additional plates underneath indicating the character's class, alignment and level. All plates are color coordinated and appear as a set.

The stack is an alternative to a traditional miniature. The new character uses a ring of flight, and soars above the battle. The player places a plate of the same basic color under the stack, but with light blue corners. This indicates that the character is flying between 0–20 feet off the ground, yet the color coordination provides a strong sense of continuity for the character's new "miniature".

Alternative embodiments of the present invention are immediately suggested. These include use of a plastic snap-on mechanism rather than magnets to provide adhesion for a stack of plates. Virtually any form of connector is suggested by the present invention. The invention further suggests the use of alternative materials other than plastic such as metals, glass or the type of clay typically used in poker chips.

In a further embodiment, the invention suggests the use of mechanisms for permanently or temporarily attaching conventional miniatures to top plates such as standardized slots to receive miniatures, or ferrous metal bases to take advantage of the magnetic nature of the stacks of plates.

In still further embodiment, the invention suggests the use of top-plates with see through plastic slots or depressions for insertion of pictures or cardboard tokens; the dry-erase finish on plates enabling temporary drawings; the heavy embossing of top-plates to allow for hand-painting as is done for miniatures. The invention also suggests the use of interlocking ridges and indentations for further ease in stacking; and mechanisms for joining plates to form larger plates. Finally, the invention envisions the development of rarity-based collectable nature of product through use of partially or totally concealed packaging in conjunction with limited production of particular types of plates.

The present invention has been described in the context of the above discussed preferred embodiments. It is to be appreciated that the true nature and scope of the present invention is to be determined with reference to the claims appended hereto.

The invention claimed is:

1. A method of playing a simulation game, the method comprising:

providing a plurality of character or creature markers representing characters or creatures respectively in the simulation game;

providing a plurality of stackable game pieces adapted to be stacked underneath a character or creature marker of the plurality of character or creature markers;

enacting a simulated battle between two or more characters or creatures wherein at least a first characters or creatures inflicts damage on a second character or creature;

stacking one or more stackable pieces to underneath the second character or creature to indicate damage sustained during the simulated battle;

adding one or more stackable pieces underneath one or more characters or creatures of the plurality of character or creature markers to indicative of other attributes of the associated characters or creatures other than health; and marking with a dry or wet erase marker one or more of the stackable pieces located underneath the one or more character or creature markers to indicate another attribute of the one or more associated characters or creatures.

* * * * *